United States Patent [19]

Passoni et al.

[11] 4,186,585

[45] Feb. 5, 1980

[54] DEVICE FOR CONTROLLING THE SPEED OF A MANDREL IN CONTINUOUS RETAINED-MANDREL ROLLING MILLS

[75] Inventors: Teresio Passoni, Magenta, Italy; Jean P. Calmes, Lausanne, Switzerland; Filippo Cattaneo, Milan, Italy; Aurindo Nessi, Albate, Italy

[73] Assignee: Innocenti Santeustacchio S.p.A., Brescia, Italy

[21] Appl. No.: 898,118

[22] Filed: Apr. 20, 1978

[30] Foreign Application Priority Data

May 5, 1977 [IT] Italy ..... 23217 A/77

[51] Int. Cl.[2] ..... B21B 25/02

[52] U.S. Cl. ..... 72/208; 72/97

[58] Field of Search ..... 72/208, 209, 97, 250, 72/214

[56] References Cited

U.S. PATENT DOCUMENTS

| | | | |
|---|---|---|---|
| 1,808,631 | 6/1931 | Bungeroth | 72/97 X |
| 1,936,790 | 11/1933 | Heetkamp | 72/209 |
| 2,145,184 | 1/1939 | Long | 72/97 |
| 3,416,346 | 12/1968 | Arrington | 72/208 X |

*Primary Examiner*—Milton S. Mehr

*Attorney, Agent, or Firm*—Birch, Stewart, Kolasch & Birch

[57] ABSTRACT

A device for controlling the speed of a mandrel in a continuous retained-mandrel rolling mill, such device comprising a rod having a double rack provided at one end with a means for removably securing an end of a mandrel and a number of pinions engaging the rack on the rod, each pinion being driven in rotation by a corresponding motor-driven shaft which, via respective clutches is connected to a motor and speed-reducing group provided with a brake for each motor-driven shaft. Further, the device includes a second set of pinions engaging the rack on the rod, each pinion being driven in rotation by a corresponding motor and speed-reducing group provided with a brake.

9 Claims, 3 Drawing Figures

DEVICE FOR CONTROLLING THE SPEED OF A MANDREL IN CONTINUOUS RETAINED-MANDREL ROLLING MILLS

BACKGROUND AND SUMMARY OF THE INVENTION

The invention relates to a device for controlling a speed of the mandrel in continuous retained-mandrel rolling mills.

It is known that when a perforated bloom secured to a mandrel is continuously rolled, the rolls in the various housings subject the mandrel to tensile forces which, if the mandrel was loosely mounted, would drive it at a speed which varied during the rolling operation. It is also known that variations in the speed of the mandrel through the successive housings will result in unacceptable defects in the final rolled tube.

Accordingly, to avoid this serious disadvantage, the mandrel must be moved at a controlled speed.

To this end continuous rolling mills used for the aforementioned method of rolling are fitted with devices which oppose the tensile forces exerted by the rolls on the mandrel and move it at a predetermined speed through the successive housing. In the prior art, these devices are usually called "mandrel-retaining devices", whereas a rolling mill fitted with such devices is called a "continuous retained-mandrel rolling mill".

The retaining devices used hitherto are mainly of the screw or hydraulic kind.

In the prior art screw devices, one end of the mandrel is suitably shaped (i.e. the mandrel head) and engages a corresponding seat formed centrally in a cross-member, the ends of which are formed with two female threads each coupled to a screw having a length adapted to retain the mandrel so that it moves over a required predetermined distance.

In the hydraulic devices, the cross-member bearing the mandrel head is laterally secured to oil actuated cylinders which have the stroke required for retaining the mandrel so that it moves in the desired manner.

It is particularly difficult to control the speed of a mandrel since, during lamination, the tensile forces exerted on the mandrel may vary suddenly as the mandrel is engaged by the successive housings. Furthermore the tensile forces, particularly in large rolling mills, may reach peaks of 400 tons, so that the mandrel moves at speeds of up to 1 m/second. Consequently, screw retaining devices give satisfactory results only at moderate speeds and moderate, constant loads. However, screw retaining devices are quite inadequate for high speeds or loads, since the specific pressures on the sliding surfaces, the speed of sliding and the difficulty of lubrication result in rapid deterioration of the screw and thread couplings.

In hydraulic retaining devices, the heavy loads accompanied by sudden variations in intensity produce resonance effects owing to the compressibility of the hydraulic fluid and the resilience of the tubes, thus causing the mandrels to vibrate sufficiently to break the lubricating layer interposed between the mandrel and the rolled bloom. As is well known, a break in the lubrication adversely affects the life of the mandrels, resulting in variations in the tensile force exerted on the mandrel, and resulting in further resonance in the hydraulic retaining device, with a cumulative negative effect on the entire rolling operation.

The invention is based on the problem of devising a mandrel-retaining device in continuous retained-mandrel rolling mills. The device includes structural and functional characteristics which completely obviate the aforementioned disadvantages of the prior art.

To accomplish the result, according to the invention, the device comprises:

a rod having a double rack provided at one end with a means for removably securing an end of a mandrel, a number of pinions engaging the rack on the rod, each pinion being driven in rotation by a corresponding motor-driven shaft which, via respective clutches is connected to:

a motor and speed-reducing group provided with a brake for each motor-driven shaft.

According to another feature of the invention, the device comprises a second set of pinions engaging the rack on the rod, each pinion being driven in rotation by a corresponding motor and speed-reducing group provided with a brake.

BRIEF DESCRIPTION OF THE DRAWINGS

Other features and advantages of the invention will be clear from the following detailed description of an embodiment of a device according to the invention with reference to the accompanying drawings in which.

DETAILED DESCRIPTION OF THE INVENTION

Figure 1:
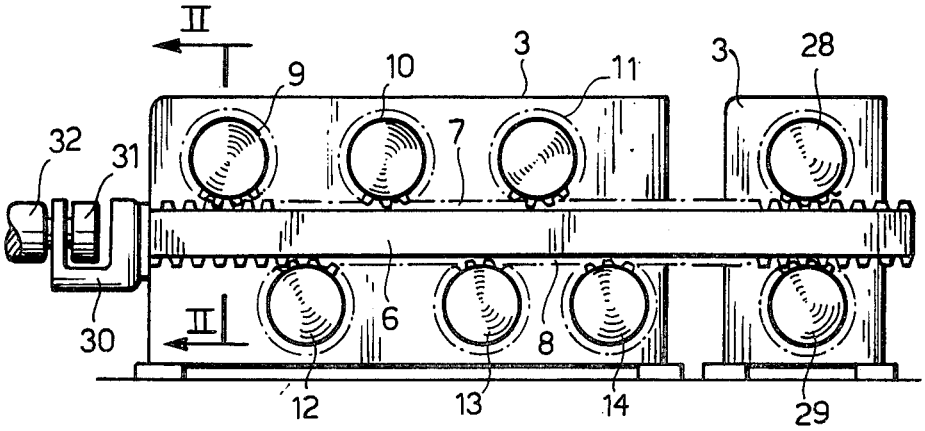
FIG. 1 is a diagrammatic side view of a mandrel-retaining device according to the invention.

In the drawings, references 1 and 2 denote two sides of a conventional bearing structure 3 inside which two rectilinear parallel guides 4, 5 are longitudinally secured and bear a rod 6 which can move and extends longitudinally between sides 1, 2. Similar racks 7, 8 having a similar pitch are formed above and below rod 6, which has a substantially rectangular cross-section and a predetermined length. Rack 7 kinematically engages three pinions 9, 10, 11 borne loosely by sides 1, 2, the axes of rotation of the pinions being perpendicular to the sides and equally spaced along the sides. Rack 8 kinematically engages three pinions 12, 13, 14 likewise loosely held by sides 1, 2, their axes of rotation being perpendicular to the sides and offset relative to the axes of the abovementioned pinions 9, 10, 11. Since all the pinions 9–14 are identical, the following description by way of example is given with reference to only one pinion, i.e. 9.

Figure 2:
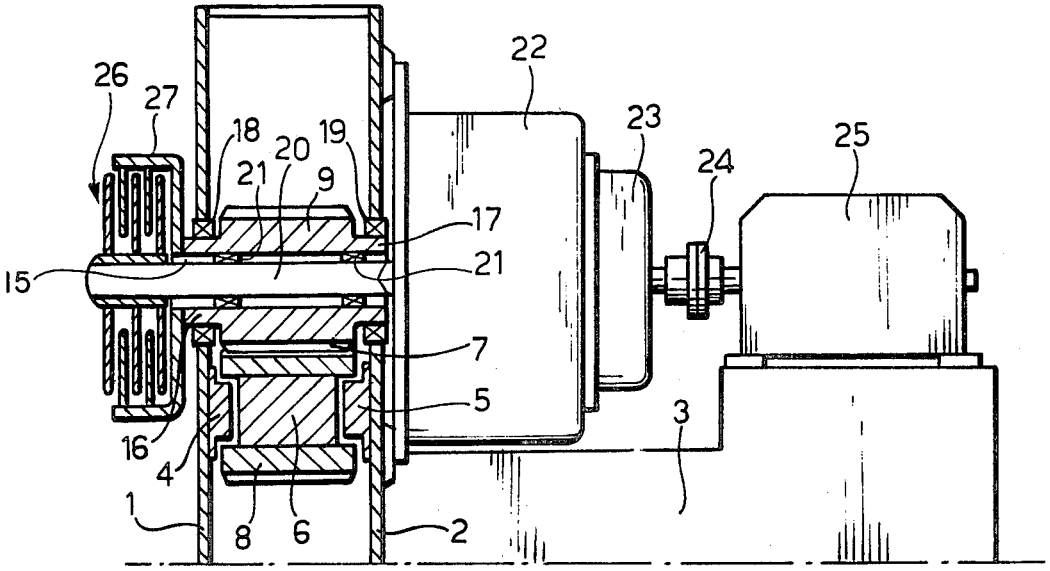
FIG. 2 is a larger-scale partial cross-section along line II—II in FIG. 1.
Figure 3:
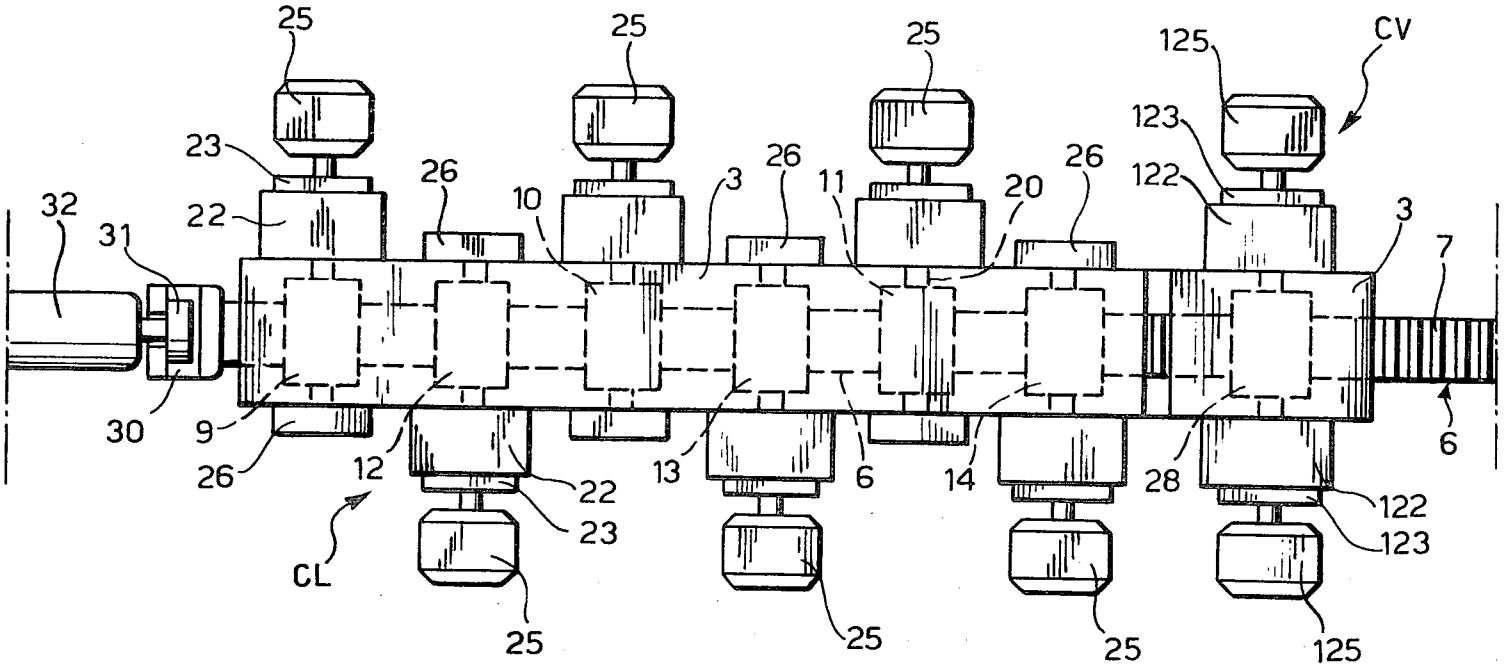
FIG. 3 is a diagrammatic plan view of the retaining device as illustrated in FIG. 1.

In FIG. 2, each pinion substantially has an orifice 15 formed at the opposite ends with hub portions 6–7 by means of which, with interposition of bearings shown diagrammatically at 18 and 19, the pinion is loosely held by sides 1, 2.

Reference 20 denotes a motor-driven shaft extending axially through orifice 15 in the pinion. Bearings diagrammatically indicated at 21 hold shaft 20 away from the inner walls of orifice 15. The portion of the shaft 20 which projects from the side 2 is secured in known manner to a conventional speed-reducing unit diagrammatically indicated at 22 and actuated by a d.c. motor 25, with interposition of a brake 23 and coupling 24.

A known clutch, e.g. a disc clutch bearing the general reference 26, is secured in a conventional manner to shaft 20 which projects from the side 1. The casing 27 of the clutch 26 rotates integrally with pinion 9.

The set of pinions 9–14, and the associated clutches 26, reducing gears 22, brakes 23 and d.c. motors 25 form a slow control unit (CL) used for retaining the mandrel as will be described hereinafter. Racks 7, 8 of rod 6 also engage identical pinions 28, 29 rotatably mounted on the sides 1, 2 of the housing structure 3. Each pinion 28, 29 is actuated by a d.c. motor 125 fitted with a corresponding brake 123 and a speed-reducing gear 122.

Pinions 28, 29 and the associated motor systems form a rapid control unit (CV) actuating the rod 6 as will be described hereinafter.

Rod 6 has a substantially hook-shaped end 30 for removably securing the head 31 of a mandrel 32 which, after being inserted into an axially bored bloom (not shown) is used for rolling the bloom in a continuous retained-mandrel rolling mill, of which the aforementioned slow and rapid control units constitute an integral part according to the invention.

The device according to the invention operates as follows:

In an initial state, all the d.c. motors 25, 125 are inoperative, brakes 23, 123 are closed, and all the clutches 26 are uncoupled. Under these conditions, pinions 9–14 of the slow control unit CL and pinions 28, 29 of the rapid control unit CV rest loosely on the respective motor-driven shafts 20, which are motionless.

Next, mandrel 31 is rapidly fitted into a corresponding axially-bored bloom so that the bloom can be rolled. To this end, the hook-shaped end 30 of rod 6 fits into the mandrel head 31 and the rapid control unit CV is used. More particularly brakes 123 of unit CV are opened and the d.c. motors 125 are switched on. Rod 6, which is actuated by pinions 28, 29 engaging the racks 7 and 8, acts in practice as a thrust member on mandrel 32, at a speed which depends on the speed of the d.c. motors 125.

After mandrel 32 has been fitted into the corresponding perforated bloom, motors 125 are stopped.

Next, after all the clutches 26 of the slow control unit CL are engaged and the respective brakes 23 have opened, unit CL is ready to operate at the same time as the bloom secured to mandrel 32 is rolled. Unit CL is adapted to control the speed at which the associated mandrel and bloom are conveyed through the successive housings, and effectively counteracts the tensile forces exerted on the mandrel by the rolls.

The aforementioned function of controlling the mandrel speed is performed by a number of motors 25 which, via respective speed-reducing gears 22, motor-driven shafts 20 and corresponding engaged clutches 26, control the rotation of pinions 9–14 and consequently control the motion of the rod 6 having a double rack 7,8.

At the end of the rolling operation all the motors 25 are stopped, brakes 23 are locked and clutches 26 are uncoupled, after which the rapid control unit CV is actuated in the opposite direction from that described for fitting the mandrel to the bloom, and the mandrel 32 can be rapidly extracted from the rolling mill.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A device for controlling the speed of a mandrel in a continuous retained-mandrel rolling mill, comprising:

a rod having a double rack provided at one end with a means for removably securing an end of a mandrel;

a plurality of sets of pinions engaging said double rack on the rod; and each pinion in each of said plurality of sets of pinions being driven in rotation by a corresponding motor-driven shaft operatively connected to a respective clutch, motor and speed-reducing group provided with a brake for each motor-driven shaft.

2. A device according to claim 1, wherein the motors are d.c. motors.

3. A device for controlling the speed of a mandrel according to claim 1, wherein said plurality of sets of pinions being alternately positioned on opposite sides of said rack on said rod.

4. A device for controlling the speed of a mandrel according to claim 1, wherein two sets of pinions of said plurality of sets of pinions being operatively connected to said double rack on said rod to impel said rod at a first predetermined speed.

5. A device for controlling the speed of a mandrel according to claim 4, wherein the remaining sets of pinions of said plurality of sets of pinions being operatively connected to said double rack on said rod to impel said rod at a second predetermined speed.

6. A device for controlling the speed of a mandrel in a continuous retained-mandrel rolling mill comprising:

a rod having a double rack and provided at one end thereof with a means for removably securing an end of a mandrel;

a plurality of sets of pinions engaging said double rack on said rod;

said rod being movably mounted between said plurality of sets of pinions, and said pinions being alternately positioned on opposite sides of said double rack on said rod; and each pinion in each of said plurality of sets of pinions being driven in rotation by a corresponding motor-driven shaft operatively connected to a respective clutch, motor and speed-reducing group provided with a brake for each motor-driven shaft.

7. A device for controlling the speed of a mandrel according to claim 6, wherein the motors are d.c. motors.

8. A device for controlling the speed of a mandrel according to claim 6, wherein two sets of pinions of said plurality of sets of pinions being operatively connected to said double rack on said rod to impel said rod at a first predetermined speed.

9. A device for controlling the speed of a mandrel according to claim 8, wherein the remaining sets of pinions of said plurality of sets of pinions being operatively connected to said double rack on said rod to impel said rod at a second predetermined speed.

* * * * *